US007874300B2

(12) United States Patent
Roeder

(10) Patent No.: US 7,874,300 B2
(45) Date of Patent: Jan. 25, 2011

(54) APPLICATOR AND PROCESS FOR THE PRODUCTION OF AN APPLICATOR

(75) Inventor: Georg Roeder, Schwabach (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 629 days.

(21) Appl. No.: 10/553,251

(22) PCT Filed: Jun. 17, 2005

(86) PCT No.: PCT/EP2005/006558

§ 371 (c)(1),
(2), (4) Date: Jan. 31, 2007

(87) PCT Pub. No.: WO2006/015652

PCT Pub. Date: Feb. 16, 2006

(65) Prior Publication Data

US 2007/0186950 A1 Aug. 16, 2007

(30) Foreign Application Priority Data

Aug. 6, 2004 (EP) ..... 04018716

(51) Int. Cl.
*A45D 40/26* (2006.01)

(52) U.S. Cl. ..... 132/320; 132/218

(58) Field of Classification Search ..... 132/218, 132/120, 320; 401/129, 122, 126
See application file for complete search history.

(56) References Cited

U.S. PATENT DOCUMENTS 2,099,030 A * 11/1937 Morrison ..... 427/274
2,140,009 A * 12/1938 Hand ..... 401/199
3,895,877 A 7/1975 Fomby
4,635,659 A * 1/1987 Spatz ..... 132/218
5,044,041 A 9/1991 Ljungberg
5,094,254 A 3/1992 Krueckel et al.
5,749,117 A * 5/1998 Forsline ..... 15/245.1
6,026,824 A 2/2000 Gueret
6,039,053 A 3/2000 Turrentine (Continued)

FOREIGN PATENT DOCUMENTS

DE 100 38 536 2/2002

(Continued)

OTHER PUBLICATIONS

EP0038524 Karl, Goerge, Mascara brush and process for its production, Oct. 28, 1981.*

*Primary Examiner*—Robyn Doan
(74) *Attorney, Agent, or Firm*—Bachman & LaPointe, P.C.

(57) ABSTRACT

An applicator 12 and a process for the production of an applicator 12. The applicator serves for distributing a cosmetic preparation on the skin, semi-mucous membrane or mucous membrane and comprises a holding portion 18 and an applicator portion 30 which is injected on to the holding portion 18 in the direction of the longitudinal extent of the applicator 12, wherein both the holding portion 18 and also the applicator portion 30 at least partially comprise plastic material and the plastic material of the holding portion 18 is harder than the plastic material of the applicator portion 30 and wherein the holding portion 18 does not form a core which extends into the applicator portion 30 in the direction of the longitudinal extent.

59 Claims, 5 Drawing Sheets

U.S. PATENT DOCUMENTS

| | | | | |
|---|---|---|---|---|
| 6,050,271 | A | 4/2000 | Spencer | |
| 6,616,366 | B1 | 9/2003 | Weihrauch | |
| 6,672,314 | B2 * | 1/2004 | Vayrette | 132/114 |
| 2002/0164192 | A1 | 11/2002 | Gueret | |
| 2004/0047676 | A1 | 3/2004 | Dumler | |

FOREIGN PATENT DOCUMENTS

| | | |
|---|---|---|
| DE | 202 04 111 | 7/2002 |
| EP | 1 384 417 | 1/2004 |
| GB | 2 255 714 | 11/1992 |

* cited by examiner

APPLICATOR AND PROCESS FOR THE PRODUCTION OF AN APPLICATOR

BACKGROUND OF THE INVENTION

The invention concerns an applicator comprising a holding portion and an applicator portion for distributing a cosmetic preparation on the skin, semi-mucous membrane or mucous membrane, and a process for the production of such an applicator.

Applicators of that kind are to be found in the cosmetics industry as a separate device or on various cosmetic products, in particular on cosmetic pencils which are cased in wood or plastic material, at the one end thereof, as a means for distributing or blending or smoothing the cosmetic preparation which has been applied to the skin, semi-mucous membrane or mucous membrane (eyelids, lips or the like). The cosmetic preparation involved includes all kinds of liquid, pasty, gel-like or powder substances. The applicator is intended to assist for example in achieving uniform coverage by the cosmetic preparation on the skin, achieving an application to a precisely delimited area of the skin, drawing contours more sharply, providing (streak-free) transitions, producing shading effects and the like.

As is known such applicators comprise a holding portion of metal or plastic material (holding tip) in which the applicator portion comprising any, generally soft plastic material such as for example foam, soft rubber, sponge rubber, a plastic molding or the like is fixed by clamping and/or adhesive.

This therefore involves an element comprising two different materials—in some cases even more—which are produced at different production sites and—not infrequently—are assembled at yet another different location therefrom. A metal goods manufacturer supplies for example a metal shaped portion as the holding tip, a plastic material processor supplies a suitable shaped plastic portion as the applicator portion and then, in a separate working operation, the applicator is assembled from those individual components, possibly by a third manufacturer.

As the applicator is wetted with the cosmetic preparation in use by the end consumer, it is generally provided with a cover cap, what is referred to as a 'protection cap' which—from whatever source it may originate—is at any event fitted on to the assembled adaptor, in a further working operation. The manufacturer of the cosmetic end product then fixes the applicator with cover cap to the cosmetic product that he has produced or to another handle component, in a last working operation.

The manufacturing and processing procedure involved with an applicator and thus the cosmetic end product therefore involves passing through a very large number of stations and is accordingly costly. That gives rise to the further disadvantage that the dependency on a number of manufacturers gives rise to a production and supply situation which is susceptible to disruption, as there is an increased risk that not all manufacturers/processors involved can always provide the required amount and/or quality of individual components produced.

In addition the applicator portions generally have a very large surface area, in particular when they are made from an open-pore plastic material (foamed) or flocked. In the event of improper processing, in conjunction with fluctuating air humidity, that very large surface area offers almost ideal living conditions for micro-organisms. The applicator portions therefore have to be produced and packaged very carefully, with predetermined hygiene guidelines being observed, and, in the subsequent (assembly) stages, until processing to afford the end product, the same care has to be applied in each case in assembly, further processing, packaging and/or storage thereof. In order to obviate microbial pollution the finished applicators, after assembly, can also be sterilised in a manner which is familiar to the man skilled in the relevant art. It is also possible for additives with a microbicidal or growth-inhibiting effect to be added to the plastic materials, in particular the applicator portion. That can involve for example silver ion donors.

DE 202 04 111 to the same applicant discloses for example a flocked applicator. The flocking is achieved by flocks electrostatically applied to the surface of the applicator being caused to adhere thereto. With this production process for example the above-mentioned microbial pollution and a production time which is relatively long in dependence on the adhesive drying time are found to cause problems. It has also been found that, by virtue of the statistical distribution of the flocks on the surface, application or distribution of the cosmetic preparation does not always occur uniformly. Those problems are even worsened with an increasing period of use because the flocks have a tendency to stick together, depending on the nature of the cosmetic preparation.

U.S. Pat. No. 6,616,366 discloses an applicator brush for applying mascara, which can be produced by means of a two-component injection molding process (2C process). In that case, radially projecting bristles of a softer plastic material are injection molded on a stiff plastic core. That processing process of injection molding the bristles on the core is effected at elevated temperatures, generally in the region of 200° C. or higher. Such a temperature is deadly for micro-organisms and the applicator produced therefore leaves the injection molding machine in a germ-free condition. If the applicator is completely produced in one machine in that way in a plurality of successive injection molding operations, it is possible to overcome some of the above-mentioned disadvantages such as logistical problems or microbial pollution.

While that kind of applicator is admittedly for example excellently well suited for the application of mascara to the eyelashes and at the same time separating the eyelashes, it is not suitable for distributing or smoothing cosmetic preparation on the skin, semi-mucous membrane or mucous membrane, by virtue of its surface nature and inherent stability.

The object of the invention is to provide an applicator which is suitable for distributing or smoothing cosmetic preparations on the skin or mucous membrane and which overcomes the above-indicated disadvantages of a high level of logistical and production-engineering complication and expenditure as well as microbial pollution.

SUMMARY OF THE INVENTION

The object is attained by an applicator for distributing a cosmetic preparation on the skin, semi-mucous membrane or mucous membrane, and by a process for the production of such an applicator.

In the case of such an applicator comprising a holding portion and an applicator portion which is injected on to the holding portion in the direction of the longitudinal extent of the applicator, both the holding portion and the applicator portion at least partially comprising plastic material, wherein the plastic material of the holding portion is harder than the plastic material of the applicator portion and wherein the holding portion does not form a core extending into the applicator portion in the direction of the longitudinal extent of the applicator, it is possible on the one hand to achieve the necessary inherent stability of the applicator by means of the holding portion and on the other hand, by the choice of a softer applicator plastic material, to achieve the desired tactile, coverage and distribution properties for the respective situation of use. Thus, the applicator portion and the applicator portion plastic material can be so selected that it is matched to the cosmetic preparation, the specific piece of skin and the preferred contours.

As the process according to the invention for the production of such an applicator provides that, in the two-component injection molding process, the applicator portion is injected on to the holding portion in the direction of the longitudinal extent of the applicator, by means of an injection machine—instead of being injection-molded therearound as in the case of the known mascara brushes—, the holding portion does not form a hard core. A very much higher degree of flexibility is available for the applicator or, more precisely, the applicator portion, than in the case of the known mascara brushes or also the for example flocked applicators. In addition, the disadvantages of expensive manufacture and microbial pollution in relation to the last-mentioned applicators are resolved in a simple fashion since, as mentioned, the applicator portion plastic material injection operation is effected under conditions which are deadly for micro-organisms.

In a particularly preferred feature the holding portion is at least partially produced from plastic material in the same injection machine, in an injection operation which precedes the operation of injecting the applicator portion on to the holding portion.

In that respect it is not crucial that the holding portion is entirely produced in the preceding injection operation from the holding portion plastic material or exclusively consists of plastic material. It is equally possible, prior to the holding portion injection operation, for at least one insert portion for example of metal, wood or thermosetting material to be fitted into the injection machine in the form of a tip or a retaining element for subsequent connection to the cosmetic pencil or the like, so that a composite shaped portion is produced during the injection operation, that is to say during the operation of injecting the holding portion plastic material therearound. Freedom from germs is thus also guaranteed in that case as micro-organisms or bacteria which under some circumstances are introduced into the injection machine with the insert portion are already killed off during the operation of injecting the holding portion plastic material therearound.

It is advantageous if the operation of injecting the applicator portion to the holding portion is effected in such a way that a mixing or intermingling layer is provided between the applicator portion and the holding portion. That produces a secure connection, involving an intimate join in respect of the materials involved, between the holding portion and the applicator portion, and at the same time this avoids niches between the holding portion and the applicator portion, in which micro-organisms preferably accumulate, as the materials smooth fluidly into each other. The mixing effect further provides that the applicator portion can no longer be detached from the holding portion without entailing destruction. The mixing effect occurs in a transitional region from the holding portion to the applicator portion where the surface of the holding portion is initially caused to melt by virtue of the injection of the hot applicator material thereon. The mixing layer is produced by intermingling of the applicator portion plastic material and the holding portion plastic material when the applicator portion is injected on to the holding portion.

That effect is increased, in dependence on material, by virtue of the fact that the injection operation for injecting the applicator portion on the holding portion is effected after the injection operation for producing the holding portion, before it cools down completely to ambient or room temperature. An advantageous processing temperature for the holding portion material is between 30° C. and 80° C. and preferably between 60° C. and 80° C. That corresponds to a preferred cooling time after injection of the holding portion in dependence on the thickness of material of the holding portion and the ambient temperature of between 10 and 25 seconds. With other materials however the injection operation for injecting the applicator portion to the holding portion can also be effected at a lower processing temperature (5° C. or less). In that case, by virtue of the choice of the processing temperature which is suitable in dependence on the material involved, the holding portion is caused to melt selectively to a greater or lesser degree in the operation of injecting the applicator portion thereonto, and it is thus possible to adjust the thickness of the mixing layer. An advantageous mixing layer thickness is between 1/100 mm and some 1/10 mm. Optionally the holding portion can also be pre-heated before the applicator portion is injected thereon. In that way the provision of a mixing layer can also be controlled independently of the production of the holding portion and in principle can also be applied to insert portions of thermoplastic material or the like.

Alternatively or in addition to the mixing layer which provides an intimate join in respect of the materials involved, the connecting layer has a positively locking connection between the applicator portion and the holding portion.

In order further to enhance the hygiene conditions, a cover cap/a protection cap is produced in the same injection machine or a second injection machine which is arranged near the injection machine for the applicator, preferably at the same time, with injection of the applicator portion on to the holding portion. In a particularly preferred feature the cover cap or the protection cap is fitted on to the applicator portion in a further process step in the same injection machine after the applicator portion has been injected on to the holding portion, in order in that way to be most certain of being able to avoid contact with germs. Alternatively the cover cap is fitted on to the applicator portion on an assembly device between the injection machine for the applicator and the second injection machine for the cover cap.

The tactile properties of the applicator portion can preferably be further developed by the applicator portion being formed by a casing which at least partially encloses a hollow space. Depending on the wall thickness of the casing, in that way a wide range is achieved in variability in respect of the deformability of the applicator portion, that is to say in regard to increasing the size of the contact surface between the applicator portion and the skin, in dependence on the pressure applied in the application operation. In that way the flexibility of the applicator portion can be so adjusted, in dependence on the viscosity of the respective material to be applied, that optimum handling in regard to distribution and smoothing is achieved, in matching relationship with the respective cosmetic preparation and the area of use.

Such an applicator can be produced with a process in which, when injecting the applicator portion on to the holding portion, an injection molding mold is used, having a core around which material is to be injection molded and which is dissolved out of the applicator to form the hollow space in the applicator portion after the plastic material of the applicator portion has set.

In a further advantageous embodiment the applicator portion plastic material is a thermoplastic elastomer (TPE). This may be on the one hand a block copolymer comprising blocks of different monomers. The possible variations in the chemical composition and 'architecture' of the molecular chains mean that it is possible in that way to produce plastic materials having different properties. Because of the insolubility of the individual sequences of the chains, agglomerates or physical networks of the individual component parts are formed in the plastic material. That category includes for example styrene block copolymers, thermoplastic polyester elastomers, thermoplastic polyurethanes, soft polyolefin thermoplastic materials or thermoplastic polyamide. On the other hand it is also possible to use a TPE blend comprising a thermoplastic matrix and elastic particles. By melting of the matrix, the material can be processed like a thermoplastic material, while the elastic particles impart to the plastic material its elastic suitability for use. What are important in that respect are good thorough mixing and adhesion of the matrix to the particles. That kind of material includes PP-EPDM, PP-NR, PP-IIR blends or polyolefin thermoplastic materials in the form of a PP-EPM blend.

The use of a suitable TPE material makes it possible to achieve a great band width in terms of mechanical, tactile, optical or dynamic properties, such as for example a wide range in respect of hardness, temperature resistance, resistance to deformation, oil resistance, hydrolysis resistance, weathering resistance, processibility, adhesion to the holding portion plastic materials, colorability, cushioning, strength, abrasion wear and the like.

Particularly in regard to the tactile properties, it is found to be advantageous to use a thermoplastic elastomer of a hardness of between 2 and 45 Shore A. And preferably with a material hardness of between 5 and 12 Shore A and a wall thickness of between 0.8 and 1.3 mm for the casing of the applicator portion, it is possible, with an applicator portion length of between 3 and 7 mm and particularly preferably 5 mm, to achieve very good mechanical and at the same time tactile properties. Another preferred embodiment provides a wall thickness of between 0.5 and 1 mm and an extent of the applicator portion in the direction of the longitudinal extent of the applicator (head length) of between 5 mm and 14 mm and particularly preferably between 5 mm and 10 mm, with a hardness of between 10 and 45 Shore A. In that range in particular a thermoplastic silicone elastomer has proven to be a preferred plastic material for the applicator portion.

In particular the use of thermoplastic elastomer as a blend with a silicone component makes it possible to achieve an excellent separation effect for the material at a set hardness of between 10 and 40 Shore A. In particular a thermoplastic silicone elastomer is suitable for that purpose.

In accordance with a further preferred embodiment the tactile properties can be improved if the applicator portion has a surface structure with a plurality of structural elements, the extent of which in perpendicular relationship to the applicator portion surface is less than 1.2 mm. Depending on the respective ergonomy of the entire applicator and depending on the respective application use as well as the cosmetic preparation to be applied, the surface structure can in that case have a preferred direction. In that way it is possible to set various effects such as for example a velour effect, and different material properties for the cosmetic preparation. That provides for improved distribution and/or smoothing of the cosmetic preparation with at the same time a more pleasant sensation during contact with the skin.

In the process according to the invention for the production of such an applicator, preferably the operation of injecting the applicator portion plastic material on to the holding portion involves the use of an injection molding mold with a laser-sintered negative of the surface profile of the applicator portion. In that way it is possible in a simple and reproducible fashion to produce a regularity as may be desired for the surface structure, with a profile depth as desired for the structural elements, as is not the case with the known processes.

Depending on the elasticity of the applicator portion or the hardness of the applicator portion plastic material, it is possible in that way to achieve on the one hand any desired sensation (for example velvety, rough, smooth, rubber-like and so forth) and on the other hand, depending on the respective properties of the cosmetic preparation (viscosity, surface adhesion and so forth), it is possible to achieve a desired deposit and/or coverage effect and/or a (pressure-dependent) delivery behaviour.

Depending on the respective use involved, different geometrical arrangements and dimensions of knobs, lines, grooves, bars, waves, honeycombs, cups, projections or the like are to be preferred as surface structures on the applicator portion. They can be of a regular or irregular configuration. In that way, from those with a closed surface to those with an open-pore surface, as is to be found for example in the case of a sponge applicator, it is possible to simulate a large number of applicators.

The geometrical configuration of the applicator portion in itself can also be designed in virtually any way, for example of a wedge-shaped configuration, a spherical configuration, a cylindrical configuration, with or without (flat) application surfaces (flattened portions), in the form of a ball-shaped body, in a bullet shape, in the form of a cone, plate, brush or in other design forms, in accordance with respective ergonomy and design aspects.

BRIEF DESCRIPTION OF THE DRAWINGS

Further objects, features and advantages of the invention are described in greater detail hereinafter by means of an embodiment by way of example with reference to the drawings in which.

DETAILED DESCRIPTION

Figure 1:
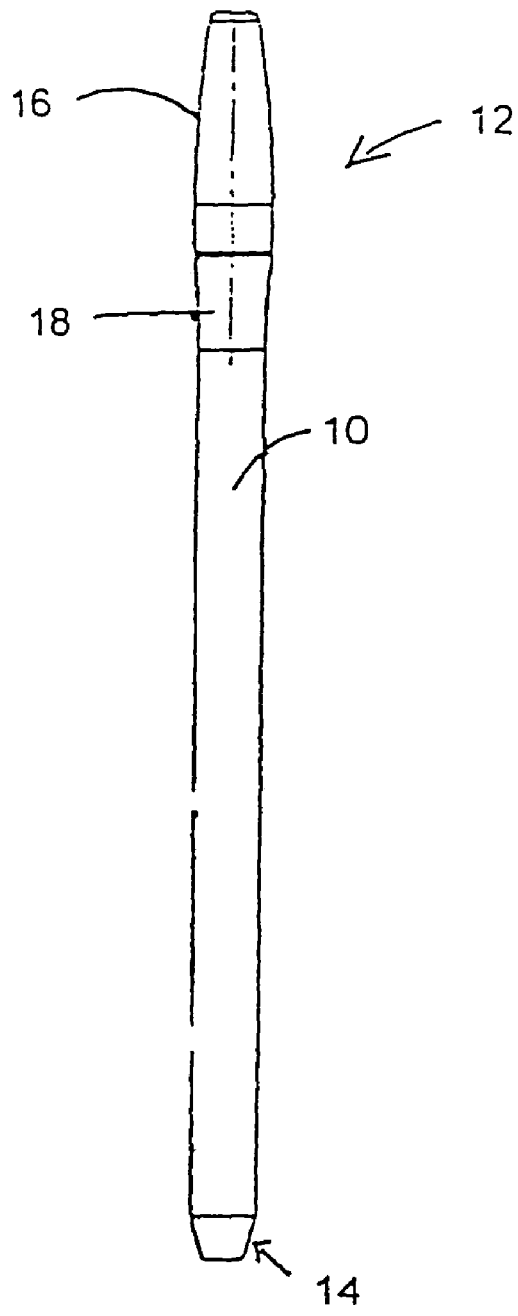
FIG. 1 is a diagrammatic view of a cosmetic pencil with an applicator according to the invention.

The cosmetic pencil as shown in FIG. 1 has at one end of its shaft 10 an applicator 12 according to the invention. The illustrated cosmetic pencil can be both a pencil encased in wood and also a pencil encased in plastic material, which in its shaft 10 has a storage means of any kind or a stick for the preparation to be applied. The cosmetic preparation can be applied for example in the case of a cosmetic pencil having a stick, after sharpening of the end 14 opposite to the applicator 12, as in the case of a pencil, and pencilled over by means of the applicator, drawn more sharply or provided with transitions. Alternatively the applicator 12 can also be in the form of a separate paintbrush-like, brush-like or spatula-like applicator element as an addition to a cosmetic product or as part of a makeup set. That list of examples of use of the applicator according to the invention are not to be considered as definitive.

The applicator 12 is closed with a cover cap or protection cap 16. For that reason the applicator portion is not visible in FIG. 1. Only a part of a holding portion 18, to which the cover cap 16 is positively lockingly connected in the manner shown in greater detail in FIG. 2 and which connects the applicator portion to the shaft 10 of the cosmetic pencil, can be seen in the region between the cover cap 16 and the shaft 10.

Figure 2:
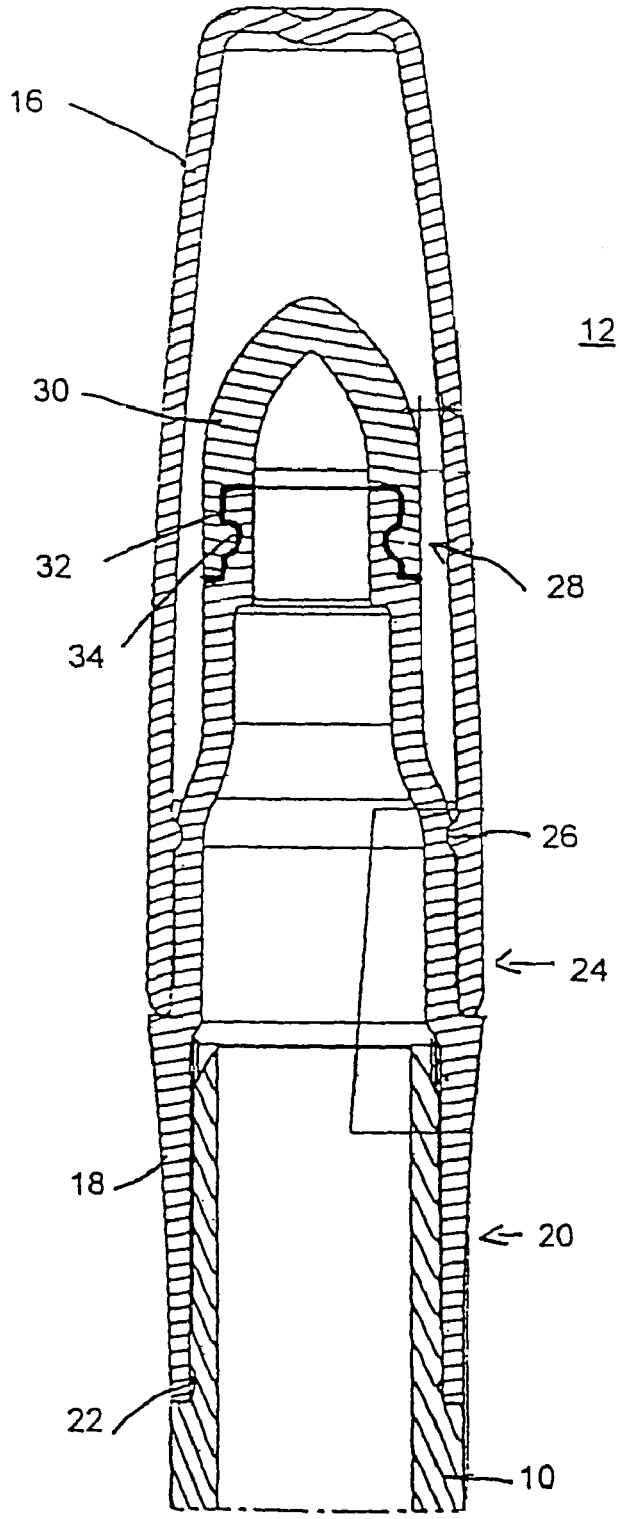
FIG. 2 shows a sectional view on an enlarged scale of the applicator of FIG. 1 with cover cap.

The applicator 12 is shown in cross-section in the enlarged view showing a part thereof in FIG. 2. The holding portion 18 of the applicator is fitted on to the shaft 10 of the cosmetic pencil. In this case the holding portion and the shaft are connected together in an assembly part 20 disposed at the lower end of the holding portion, by clamping with additional elements 22 of a positively locking snap-engagement connection comprising an annular projection at the inner periphery of the holding portion 18 and a corresponding, peripherally extending annular groove in the shaft 10. If required the durability of the connection can be enhanced by additional adhesive (for example by hot glue). It will be noted however that assembly as between the applicator 12 and the shaft 10 of the cosmetic pencil only takes place in a final mounting procedure. The actual cosmetic pencil as well as the applicator are generally supplied by different manufacturers and assembled independently of individual production. In the case of the applicator according to the invention however that can take place without the risk of impurity contamination as the applicator was firstly produced in a germ-free condition and closed with a protection cap before it was despatched and cannot come into contact with micro-organisms or other contaminating impurities, until the final assembly step.

Adjoining the assembly part 20 the holding portion 18 has a closure part 24 which is of a reduced cross-section for fixing and sealing off the cover cap 16. The closure part 24 in turn has elements 26 of a positively locking connection, comprising an interruptedly or continuously peripherally extending annular projection at the inside periphery of the cover cap 18, which latches into a corresponding annular groove at the periphery of the holding portion 18 by a so-called (releasable) click connection. The elements 26 of the positively locking connection can also be so designed that a gas-tight closure is achieved between the cover cap and the holding portion so that for example fluids in the cosmetic preparation cannot evaporate and the preparation therefore does not 'dry out'. The gas-tight closure can admittedly also be achieved by separate sealing elements.

The closure part 24 is prolonged by a holding part 28 for fixing the applicator portion 30 to the holding portion 18. In the present case the applicator portion 30 is in the form of a hollow body of a bullet-like shape. In accordance with the invention the hollow body is produced by injection on to the holding portion 18 in a suitable injection molding mold with a core around which material is to be injection molded and which is dissolved out of the applicator to form the hollow space in the applicator portion, after the plastic material of the applicator portion has set. If the holding portion 18 is preferably made from thermoplastic material such as polyethylene, polypropylene, polyvinylchloride, polyacetate, polyacetal, polystyrene or its mixed polymers, or polyamide, and if the applicator portion 30 of thermoplastic elastomer, silicone rubber, NBR, soft PVC or the like is injected on to the holding portion 18 immediately after injection-molding thereof, a connecting layer 32 is formed, in which the various kinds of plastic materials of the holding portion 18 and the applicator portion 30 mix and mingle with each other (for example by diffusion). When such an applicator is cut open, that mixing layer can be seen and analysed with the naked eye or under the microscope respectively. The connecting layer 32 will be of greater or lesser thickness depending on the respective temperature of the holding portion when the applicator portion is injected thereonto.

Independently of the connection between the holding portion 18 and the applicator portion 30 by the mixing layer 32, that connecting layer also has elements 34 of a positively locking connection, namely a peripherally extending annular groove at the outer periphery of the holding portion 18 and a corresponding, peripherally extending annular projection at the inner periphery of the applicator portion 30.

As shown, those elements 34 can be provided in addition to the connection by intermingling mixing in order to enhance the strength of the connection between the holding portion 18 and the applicator portion 30 without worsening the hygiene properties, but they are not absolutely necessary.

Figure 3:
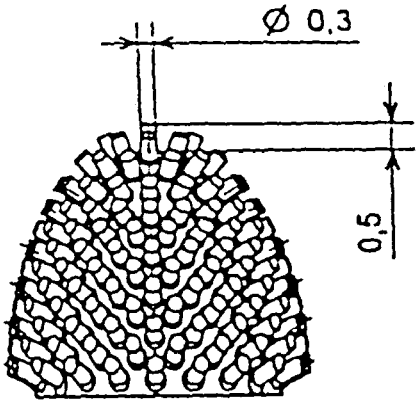
FIG. 3 shows a side view of the applicator portion of a first embodiment of the applicator according to the invention with a bristle-like surface structure.

FIG. 3 shows the applicator portion of the applicator according to the invention in a first embodiment whose surface structure has a plurality of structural elements in the form of bristles. The applicator portion is rotationally symmetrical about its longitudinal axis which is vertical in this view and which coincides with the direction of the longitudinal extent of the applicator (not shown). In the illustrated manner, the applicator portion is injected with its wide (lower) end on to the holding portion (not shown), in the manner illustrated in FIG. 1. The applicator portion tapers in the direction of its longitudinal extent with an increasing distance from the holding portion (not shown). In that respect the degree of taper increases towards the tip, thereby providing a characteristic bullet-like shape. The bristles are shown on an enlarged scale for illustration purposes in FIG. 3—as also in following FIGS. 4 through 11—. In the case shown in FIG. 3 they are of a mean diameter of about 0.3 mm, with a length of 0.5 mm. The bristles are all substantially perpendicular to the surface of the applicator portion.

Figure 4:
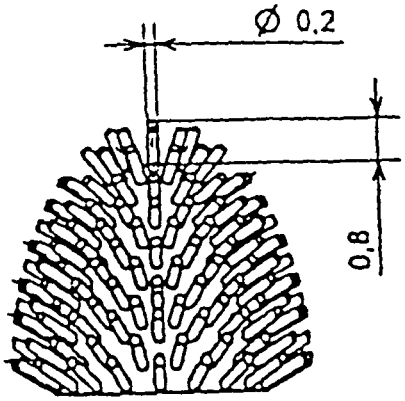
FIG. 4 shows a side view of the applicator portion of a second embodiment of the applicator according to the invention with a bristle-like surface structure.

FIG. 4 also shows an applicator portion of the characteristic bullet-like shape, having bristle-like structural elements on its surface. The dimensions of the individual bristles however are selected to be different in comparison with those of the embodiment shown in FIG. 3. The diameter of the individual bristles is about 0.2 mm while the length thereof is about 0.8 mm. In this embodiment the bristles are also not applied to the surface of the applicator portion in such a way as to cover the surface area thereof. That design configuration results in larger intermediate spaces between the individual bristles, which, together with the smaller cross-section and greater length of the bristles, contribute to making the bristles overall more flexible, that is to say more easily deformable under pressure. On the other hand, the larger spacings provide that there is a larger volume for receiving the cosmetic preparation to be distributed (holding volume), than in the case of the above-shown applicator. On the other hand, the capillary force is reduced by virtue of the larger bristle spacings. In that way on the one hand the coverage entrainment capability and the delivery characteristics of the applicator portion can be adapted to the respective requirement involved, in dependence on the viscosity and texture of the cosmetic preparation, and on the other hand the sensation on the skin when applying the preparation can be adapted to the respective needs concerned. Further adaptation effects can also be achieved by way of the hardness of the applicator portion plastic material used. Finally it is to be noted that the application properties can also be varied by an adjustable preferred direction for the structural elements. It can be seen for example in FIG. 4 that the bristles in the lower part of the applicator portion have a slight inclination upwardly—that is to say they are not perpendicular to the surface of the applicator portion—, whereby the applicator portion slides over the skin more easily in a direction when the applicator is guided over the skin in the direction of its longitudinal extent (downwardly).

Figure 5:
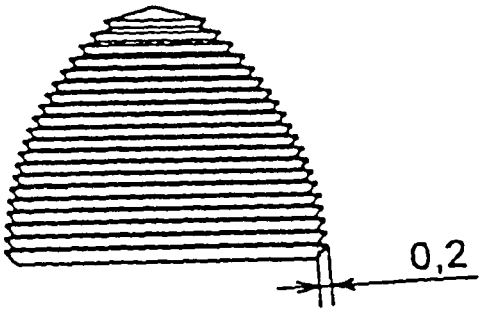
FIG. 5 shows a side view of the applicator portion of a third embodiment of the applicator according to the invention with a slat-like surface structure.

In the embodiment of the applicator portion shown in FIG. 5 the surface structure comprises bars or slats which are closed in an annular configuration and which are arranged substantially rotationally symmetrically around the direction of the longitudinal extent of the applicator, which again coincides with the axis of rotational symmetry of the illustrated applicator portion. The height of the individual slats, that is to say the extent thereof perpendicularly to the applicator surface, is 0.2 mm in the illustrated embodiment. That comparatively low structure involves only a low level of deformability. As a counterpart the coverage entrainment properties in the direction of the longitudinal extent of the applicator are better. This applicator makes it possible to achieve particularly uniform smoothing, in particular in regard to more viscous textures. In addition, the rotational symmetry means that the orientation of the applicator around the axis of rotation is irrelevant, and that simplifies handling of the applicator.

Figure 6:
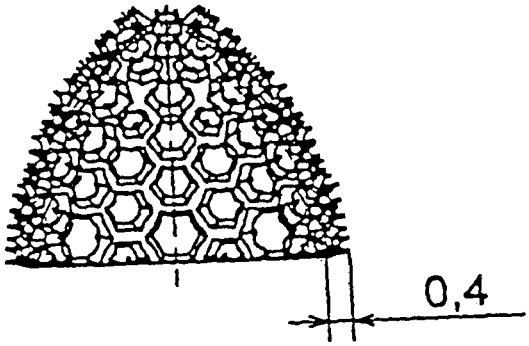
FIG. 6 shows a side view of the applicator portion of a fourth embodiment of the applicator according to the invention with a crown-like surface structure.

FIG. 6 shows an embodiment by way of example of an applicator portion with crowns as the structural elements. The crowns are hexagonal and at their periphery have respective prongs arranged at the corners. The crowns are of different cross-sections. In the region of the applicator portion of larger cross-section, the cross-section of the crowns is also increased while the cross-section of the crowns is also smaller in the region of the tapered tip of the applicator portion. The prongs on the crowns are of a length of between about 0.2 mm and 0.4 mm over the base surface of the applicator portion while the surface of the crowns is respectively shaped out in a cup-like configuration at the center thereof. The particularity of the crown structure is that, even with a tapered tip on the applicator portion, it has an arrangement, which is repeated in the same manner, of prongs at almost uniform spacings between the crowns over the entire applicator portion. Overall that ensures good coverage of the applicator portion with structural elements, and that ensures uniform application of cosmetic preparations without streaking.

Figure 7:
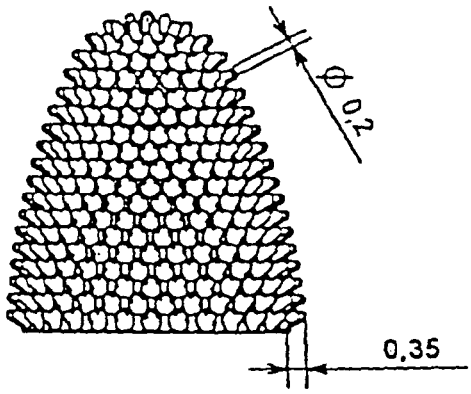
FIG. 7 shows a side view of the applicator portion of a fifth embodiment of the applicator according to the invention with a knob-like surface structure.

The embodiment of FIG. 7 shows an applicator portion which is distinguished on the one hand by a larger dimension in the direction of the longitudinal extent. By virtue of that configuration, with the casing of the hollow applicator portion being of a uniform wall thickness and with the plastic material of the applicator portion being of the same hardness, that provides a higher degree of deformability and thus a higher degree of shaping adaptation of the applicator portion to the skin. The structural elements on this applicator portion surface are knobs. They differ from the bristles shown in FIGS. 3 and 4 by virtue of rounded-off ends. The bristles are also not so high in their extent in perpendicular relationship to the surface of the applicator portion. They are of a height of about 0.35 mm, with a diameter of about 0.2 mm. By virtue of the rounded-off tips of the knobs, they in turn produce a different sensation upon being applied to the skin. Even when the plastic material is of greater hardness, the knobs slide more gently and softly over the skin than the bristles. As a counterpart their coverage entrainment properties are somewhat reduced, because of the lack of sharp edges. In the embodiment shown in FIG. 7 the density of the bristles is very high, which reduces the holding volume for the cosmetic preparation to be distributed but increases the holding force by virtue of the capillary forces and thus the smoothing properties of the applicator portion.

Figure 8:
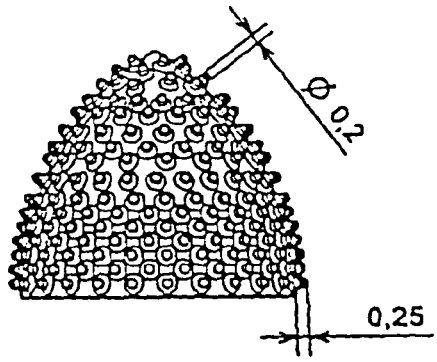
FIG. 8 shows a side view of the applicator portion of a sixth embodiment of the applicator according to the invention with a knob-like surface structure.

FIG. 8 shows an embodiment of an applicator according to the invention, which again has knobs as the structural elements. They extend about 0.25 mm perpendicularly to the applicator portion surface and involve an overall less dense distribution on the applicator portion. The distribution on the applicator portion surface is also more irregular. That arrangement overall—similarly to a coarse comb—makes it possible to achieve coarser distribution of the cosmetic preparation, possibly with deliberate streaking.

Figure 9:
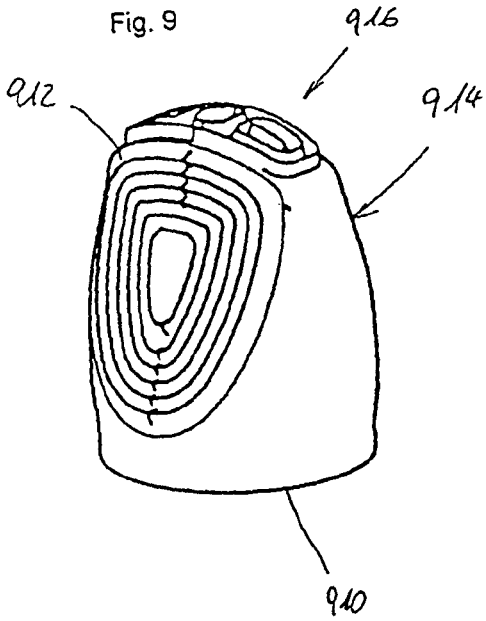
FIG. 9 shows a perspective view of the applicator portion of a seventh embodiment of the applicator according to the invention with a slat-like surface structure.
Figure 10:
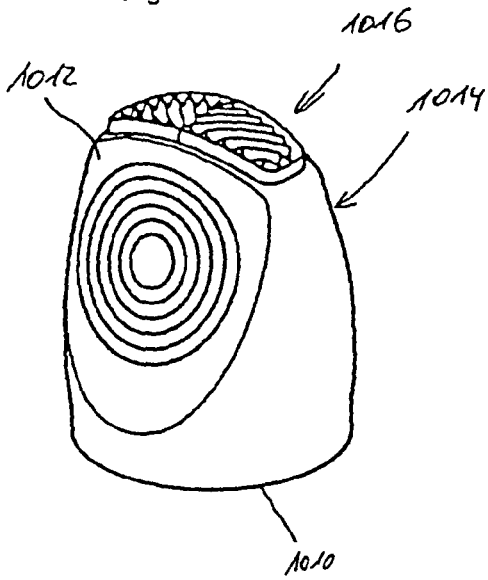
FIG. 10 shows a perspective view of the applicator portion of an eighth embodiment of the applicator according to the invention with a slat-like surface structure.

FIGS. 9 and 10 each show respective applicator portions which at their end towards the holding portion have a respective cylindrical connecting part 910 and 1010 respectively. At that location the applicator portions are injected on to the respective holding portion (not shown). The applicator portions each also have two oppositely disposed, substantially even, flattened portions 912 and 914, 1012 and 1014 respectively. The flattened portions are inclined relative to each other so that the applicator portion converges towards a point in a wedge-shaped configuration away from the respective connecting surface 910 and 1010 respectively. In the plane of the flattened portions, the applicator portion substantially retains its dimensions over the entire head length. At its end in opposite relationship to the respective connecting surface 910 and 1010 respectively, the applicator portion also has a narrow, substantially even, flattened portion 916 and 1016 respectively. All three flattened portions 912, 914, 916, and 1012, 1014 and 106 respectively are provided with slat-like structural elements. Those slat-like structural elements are in part closed in an annular configuration and in part not. In particular the lateral surface-like flattened portions 912 and 914, and 1012 and 1014 respectively afford an enlarged contact surface on the applicator portion for application to the skin. In that way relatively large regions of the skin can be simultaneously smoothed in or the cosmetic preparation thereon can be distributed. The narrower structures on the respective end flattened portions 916, 1016 are suitable for finer contours.

Figure 11:
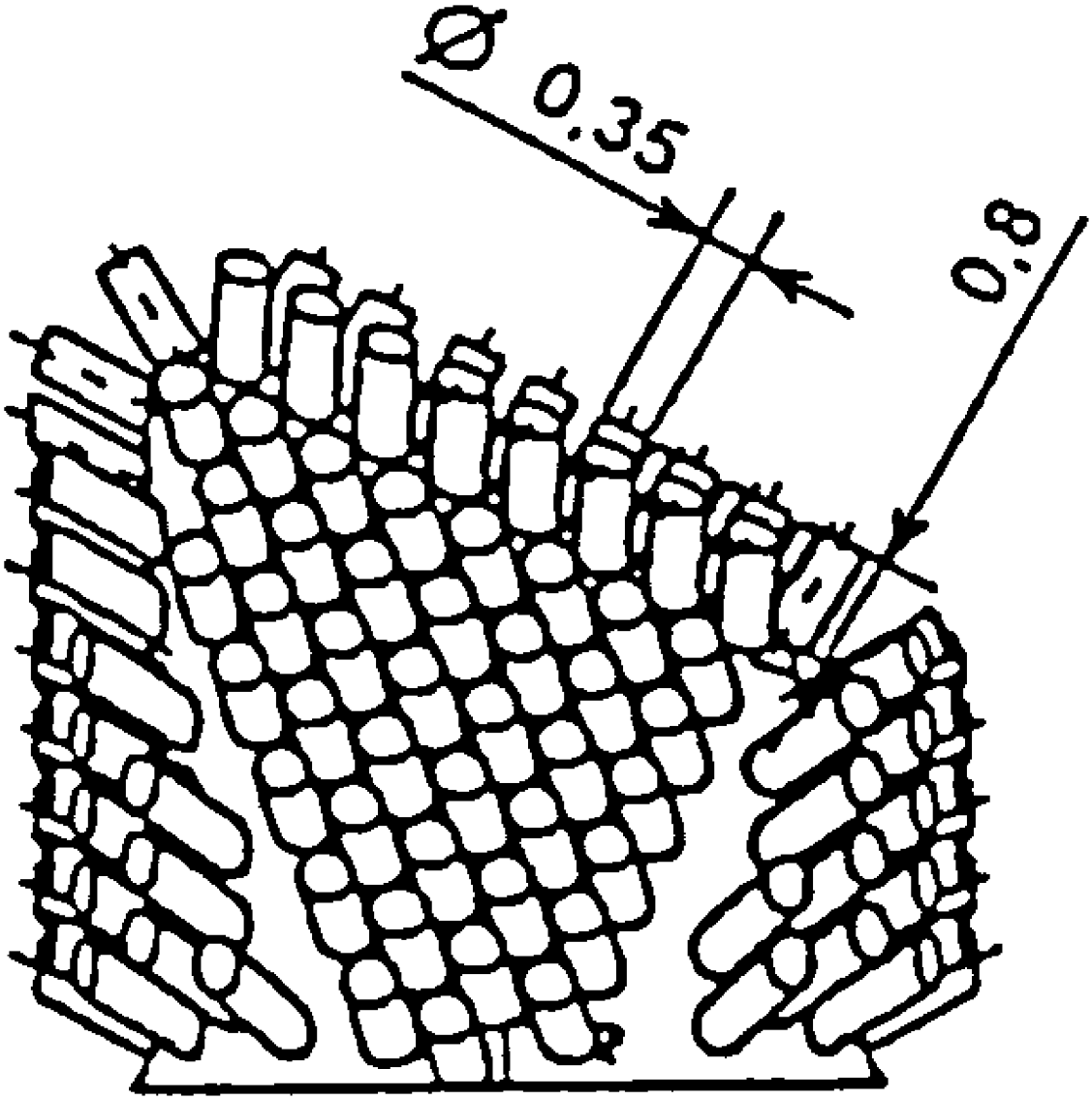
FIG. 11 shows a side view of the applicator portion of an applicator according to the invention with a further bristle-like surface structure.

FIG. 11 shows a further embodiment of an applicator portion with bristle-like structural elements. The individual bristles are of a diameter of 0.35 mm and a height above the applicator portion surface of 0.8 mm. The applicator surface portion is moreover subdivided into 'macroscopic' structures, within which are arranged differing numbers of bristles with a uniform packing density. Between the individual macroscopic regions there are gaps in which there are no structural elements. In addition, on its end in opposite relationship to the connecting part, that applicator portion has a surface which is inclined relative to the longitudinal axis and which permits particularly good ergonomic handling when distributing cosmetic preparations with the applicator pencil set in an inclined position.

What is common to all the illustrated embodiments of applicator portions is that, in comparison with for example flocked applicators, they involve only a slight increase in surface area, that is to say they have a structural surface which is smaller in relation to the base surface of the applicator portion, whereby the risk of microbial contamination even after the first use is reduced.

Also the coverage entrainment capability (the holding volume and the holding force) can be adjusted very much more specifically and deliberately by virtue of the choice of suitable structural elements and can thus be individually matched to any situation of use, that is to say to the part of the skin intended for application, and the properties of the cosmetic preparation (viscosity, surface adhesion, coverage). That is facilitated by the injection molding process according to the invention, which is characterised by the use of an injection molding mold with a laser-sintered negative of the surface profile of the applicator portion.

The coverage entrainment capability can also be adjusted to the respective situation of use by a suitable choice of the frictional resistance, for example by making a suitable choice of the applicator portion plastic material and the hardness thereof.

The provision of a hollow space in the interior of the applicator portion and the appropriate choice of the wall thickness and of the applicator portion plastic material makes it possible for the deformation of the applicator portion and thus the increase in surface area by the pressure applied in the application operation to be very specifically and targetedly set, which also achieves the respectively desired application result, in dependence on the product involved.

Basically any surface structure can have one or more preferred directions which do not necessarily have to be perpendicular to the applicator portion surface. The preferred direction of the structural elements can also be set in dependence on the ergonomic handling of the applicator, depending on the respectively intended use.

The structures referred to by way of example can also be used in combination on the same applicator portion. For example, different structures can be provided on opposite surfaces of the same applicator portion for different uses (smoothing, distributing, and so forth). It is also possible for the structural elements to be mixed on an application surface or over the entire applicator portion.

The invention claimed is:

1. An applicator (12) for distributing a cosmetic preparation on the skin, semi-mucous membrane or mucous membrane, comprising a holding portion (18) and an applicator portion (30) whereby the holding portion (18) has a holding part (28) and whereby the applicator portion (30) is fixed in a direction of longitudinal extent of the applicator (12) by means of a connecting part (910; 1010), wherein both the holding portion (18) and also the applicator portion (30) at least partially comprise plastic material and the plastic material of the holding portion (18) is harder than the plastic material of the applicator portion (30), the holding portion (18) extends in the direction of longitudinal extent only till the end of the connecting part (910; 1010) into the applicator portion (30) and, provided between the holding portion (18) and the applicator portion (30) is a connecting layer (32) comprising a mixing layer comprising the applicator portion plastic material and the holding portion plastic material.

2. An applicator (12) as set forth in claim 1, wherein the mixing layer is between 1/100 mm and several 1/10 mm thick.

3. An applicator (12) as set forth in claim 1, wherein the connecting layer (32) has a positively locking connection (34) between the applicator portion (30) and the holding portion (18).

4. An applicator (12) as set forth in claim 1, wherein the applicator portion (30) is formed by a casing which at least partially encloses a hollow space.

5. An applicator (12) as set forth in claim 1, wherein the applicator portion (30) forms an extension in the direction of longitudinal extent of less than 14 mm.

6. An applicator (12) as set forth in claim 1, wherein the applicator portion (30) extends at least in portion-wise manner rotationally symmetrically in the direction of the longitudinal extent of the applicator (12).

7. An applicator (12) as set forth in claim 1, wherein the applicator portion (30) tapers away from the holding portion (18) in the direction of the longitudinal extent of the applicator (12).

8. An applicator (12) as set forth in claim 1, wherein the applicator portion (30) has at least one substantially even, flattened portion (916, 1016).

9. An applicator (12) as set forth in claim 1, wherein the applicator portion plastic material contains silicone rubber.

10. An applicator (12) as set forth in claim 1, wherein the applicator portion plastic material contains soft PVC.

11. An applicator (12) as set forth in claim 1, wherein the applicator portion plastic material comprises a thermoplastic elastomer.

12. An applicator (12) as set forth in claim 11, wherein a block copolymer is used as the applicator portion plastic material.

13. An applicator (12) as set forth in claim 11, wherein the thermoplastic elastomer is a blend of thermoplastic substance with elastic particles.

14. An applicator (12) as set forth in claim 11, wherein the thermoplastic elastomer has a hardness of between 2 and 45 Shore A.

15. An applicator (12) as set forth in claim 14, wherein the casing has a hardness of between 10 and 45 Shore A, a wall thickness of between 0.5 mm and 1 mm and an extension in the direction of longitudinal extent of between 5 mm and 10 mm.

16. An applicator (12) as set forth in claim 11, wherein the thermoplastic elastomer has a hardness of between 5 and 12 Shore A.

17. An applicator (12) at least as set forth in claim 11, wherein the applicator portion plastic material comprises a thermoplastic silicone elastomer having a hardness of between 10 and 30 Shore A.

18. An applicator (12) as set forth in claim 1, wherein the casing has a wall thickness of between 0.8 mm and 1.3 mm and an extension in the direction of the longitudinal extent of between 3 mm and 7 mm.

19. An applicator (12) as set forth in claim 18, wherein the casing has a hardness of between 5 and 12 Shore A, a wall thickness of between 0.8 mm and 1.3 mm and an extension in the direction of longitudinal extent of about 5 mm.

20. An applicator (12) as set forth in claim 1, wherein the applicator portion (30) has a surface structure comprising a plurality of structural elements.

21. An applicator (12) as set forth in claim 20, wherein the structural elements extend substantially perpendicularly to the applicator portion surface a distance of less than 1.2 mm.

22. An applicator (12) as set forth in claim 21, wherein the structural elements include knobs.

23. An applicator (12) as set forth in claim 22, wherein the knobs extend between 0.25 mm and 0.5 mm.

24. An applicator (12) as set forth in claim 23, wherein the knobs have a diameter of between 0.1 and 0.3 mm.

25. An applicator (12) as set forth in claim 22, wherein the knobs extend 0.35 mm.

26. An applicator (12) as set forth in claim 25, wherein the knobs have a diameter of 0.2 mm.

27. An applicator (12) as set forth in claim 21, wherein the structural elements include crowns with respective peripherally arranged prongs.

28. An applicator (12) as set forth in claim 27, wherein the crowns are hexagonal having a respective prong arranged at each corner.

29. An applicator (12) as set forth in claim 27, wherein the crowns are of different cross-sections.

30. An applicator (12) as set forth in claim 27, wherein the prongs extend substantially perpendicular to a surface of the applicator portion of between 0.2 mm and 0.6 mm.

31. An applicator (12) as set forth in claim 27, wherein the prongs extend substantially perpendicular to a surface of the applicator portion of 0.4 mm.

32. An applicator (12) as set forth in claim 20, wherein the structural elements include slats.

33. An applicator (12) as set forth in claim 32, wherein the slats extend perpendicularly to the applicator portion surface a distance of between 0.1 mm and 0.3 mm.

34. An applicator (12) as set forth in claim 32, wherein the slats extend perpendicularly to the applicator portion surface a distance of between 0.2 mm and 0.3 mm.

35. An applicator (12) as set forth in claim 32, wherein the slats are oriented substantially transversely with respect to the direction of the longitudinal extent of the applicator.

36. An applicator (12) as set forth in claim 32, wherein the slats are annularly closed.

37. An applicator (12) as set forth in claim 36, wherein the slats ring are arranged substantially rotationally symmetrically around the direction of the longitudinal extent of the applicator.

38. An applicator (12) as set forth in claim 36, wherein the slats ring are arranged substantially on the even, flattened portion (916, 1016).

39. An applicator (12) as set forth in claim 20, wherein the structural elements include bristles.

40. An applicator (12) as set forth in claim 39, wherein the bristles extend perpendicularly to the applicator portion surface a distance of between 0.3 mm and 1 mm.

41. An applicator (12) as set forth in claim 40, wherein the bristles extend a distance of between 0.4 mm and 0.6 mm and have a diameter of between 0.4 mm and 0.6 mm.

42. An applicator (12) as set forth in claim 40, wherein the bristles extend a distance of between 0.7 mm and 1 mm and have a diameter of between 0.1 mm and 0.3 mm.

43. An applicator (12) as set forth in claim 1, wherein the holding portion plastic material is selected from the group consisting of thermoplastic material, polyethylene, polypropylene, polyvinyl chloride, polyacetate, polyacetal, polystyrene, mixed polymers of polystyrene and polyamide.

44. An applicator (12) as set forth in claim 1, wherein the holding portion (18) at least partially comprises a thermosetting material.

45. An applicator (12) as set forth in claim 1, wherein the holding portion (18) at least partially comprises metal.

46. A process for the production of the applicator (12) as set forth in claim 1, including the step of injecting the applicator portion (30) in the direction of the longitudinal extent of the applicator on to the holding portion (18) by means of an injection machine.

47. A process as set forth in claim 46, including producing the holding portion (18) at least partially from plastic material in the injection machine in an injection operation preceding injection of the applicator portion (30) on to the holding portion.

48. A process as set forth in claim 47, including producing a positively locking connection (34) during the injection operation between the applicator portion (30) and the holding portion (18).

49. A process as set forth in claim 47, including producing during the injection operation the mixing layer (32) between the applicator portion (30) and the holding portion (18).

50. A process as set forth in claim 49, including injecting the applicator portion on to the holding portion prior to cooling of the holding portion (18) to ambient temperature.

51. A process as set forth in claim 50, including injecting the applicator portion on to the holding portion at a processing temperature of the holding portion material of between 30° C. and 80° C.

52. A process as set forth in claim 47, including fitting the holding portion (18) with an insert portion made of thermosetting material into the injection machine prior to injecting the applicator portion (30) on to the holding portion.

53. A process as set forth in claim 47, including fitting the holding portion (18) with an insert portion made of metal into the injection machine prior to injecting the applicator portion (30) on to the holding portion.

54. A process as set forth in claim 47, including producing a cover cap (16) in the injection machine or in a second injection machine arranged near the injection machine for the applicator portion (30).

55. A process as set forth in claim 54, including fitting the cover cap (16) on to the applicator portion (30) after injecting the applicator portion (30) on to the holding portion in the injection machine.

56. A process as set forth in claim 54, including fitting the cover cap (16) on to the applicator portion (30) on an assembly apparatus arranged between the injection machine for the applicator portion (30) and the second injection machine for the cover cap.

57. A process as set forth in claim 46, including injecting the applicator portion on to the holding portion using an injection molding mold having a core around which material is injected and thereafter dissolving the core to form a hollow space in the applicator portion.

58. A process as set forth in claim 46, including injecting the applicator portion on to the holding portion of an injection molding mold having a laser-sintered negative of a desired surface profile of the applicator portion (30).

59. A process as set forth in claim 46, including producing the holding portion (18) from a material selected from the group consisting of thermoplastic material, polyethylene, polypropylene, polyvinyl chloride, polyacetate, polyacetal, polystyrene, mixed polymers of polystyrene, and polyamide.

* * * * *